US005400527A

United States Patent [19]

Marega et al.

[11] Patent Number: 5,400,527

[45] Date of Patent: Mar. 28, 1995

[54] BIOMECHANICAL SKI BOOT WITH RESILIENT ELEMENTS IN THE SOLE

[75] Inventors: Antonello Marega, Volpago del Montello; Pierluigi Lorati, Ponte di Legno; Giuseppe Goggia, Montebelluna, all of Italy

[73] Assignee: Calzaturificio Tecnica Spa, Treviso, Italy

[21] Appl. No.: 278,108

[22] Filed: Jul. 20, 1994

Related U.S. Application Data

[63] Continuation of Ser. No. 054,056 Apr. 29, 1993, abandoned.

[51] Int. Cl.[6] ..... A43B 5/04

[52] U.S. Cl. ..... 36/117; 36/28

[58] Field of Search ..... 36/117–121, 36/109, 28, 35 R, 25 R, 37, 34 R

[56] References Cited

U.S. PATENT DOCUMENTS

| | | | |
|---|---|---|---|
| 3,922,800 | 12/1975 | Miller et al. | 36/117 |
| 4,074,446 | 2/1978 | Eisenberg | 36/120 |
| 4,144,659 | 3/1979 | Eisenberg | 36/120 |
| 4,253,252 | 3/1981 | Eisenberg | 36/120 |
| 4,874,640 | 10/1989 | Donzis | 36/37 |
| 4,937,955 | 7/1990 | Bonaventure | 36/117 |
| 5,214,865 | 6/1993 | Sartor | 36/117 |

FOREIGN PATENT DOCUMENTS

| | | |
|---|---|---|
| 0432793 | 6/1991 | European Pat. Off. . |
| 2142351 | 1/1973 | France . |
| 2236438 | 2/1975 | France . |
| 2610797 | 4/1988 | France . |
| 2663821 | 1/1992 | France . |
| 2663821 | 3/1992 | France . |
| 490032 | 6/1970 | Switzerland . |

*Primary Examiner*—Steven N. Meyers
*Assistant Examiner*—Thomas P. Hilliard
*Attorney, Agent, or Firm*—Griffin, Butler, Whisenhunt & Kurtossy

[57] ABSTRACT

By embedding blocks of resilient material, where necessary reinforced, in the toe-piece and heel of the sole of a ski-boot, so that their upper surfaces make contact with a counter-sole made of rigid material internally covering the bottom of the shell and with the bottom of the wedge contained inside the shell, the responsiveness and the accuracy of transmission of the movements from the limb and foot of the skier to the ski remain unaffected, while the muscular fatigue affecting the limbs and back of the skier is substantially reduced.

8 Claims, 2 Drawing Sheets

BIOMECHANICAL SKI BOOT WITH RESILIENT ELEMENTS IN THE SOLE

This application is a continuation of Ser. No. 07/054,056, filed Apr. 29, 1993, now abandoned.

The present invention relates to ski-boots and more specifically to an improvement to the soles of these boots.

BACKGROUND OF THE INVENTION

It is well-known that modern ski-boots comprise a substantially rigid casing or shell with which a sole is associated at the bottom, while the top part is completed by a leg part which is normally hinged with the shell and shaped according to the different models (front entry, rear entry, etc.).

The ski-boot is completed internally by a shoe which comfortably supports the skier's foot.

The more recent types of ski-boots are furthermore equipped with devices for adjusting certain features which are important for ordinary or competitive use of the boot, such as for example adjustment of the lateral inclination of the boot (known as "canting"), the forward inclination of the leg-piece, the degree of bending of the said leg-piece, etc.

One of the main problems associated with the ski-boot structure briefly described above is that of the responsiveness and accuracy of transmission of the movements from the leg and foot and from the joints (heels, knees, hips) of the skier to the ski via the boot and therefore ultimately via the sole of the said boot.

Another equally important problem is that of the muscular fatigue affecting the limb of the skier in particular when the latter has to ski on a hard and not perfectly smooth surface.

Hitherto, in the design of ski-boots, more attention has been paid to solving the first problem, with the result that ski-boots have been proposed and designed so as to offer an excellent if not exceptional competitive performance, but without adequate consideration being given to the comfort of the skier. In other cases, the entirely opposite approach has been adopted, with the design of ski-boots which are extremely comfortable but unsuitable for use even of a slightly competitive nature.

The main aim of the present invention is therefore to provide a boot in which the accuracy of transmission of the movements from the leg and foot of the skier to the ski is maintained and at the same time the fatigue affecting the skier's lower limb is reduced, in particular on hard and/or uneven surfaces.

SUMMARY OF THE INVENTION

This aim is achieved with a ski-boot of the type comprising a rigid shell with which a sole is associated, as well as a leg part pivotably hinged with the said rigid shell in the sole portions via which the movements are transmitted from the skier's foot to the ski, with the insertion of mounted elements made of non-rigid material, preferably resilient material incoporating, where necessary, stiffening elements extending over most or all of the width of the sole, characterized in that the upper surfaces of said mounted elements make contact with a counter-sole made of rigid material internally covering the shell and/or with a wedge housed inside the shell.

In the preferred embodiment, said sole consists of a toe-piece and a heel fixed separately to the shell, and said mounted elements are in the form of blocks embedded in the toe-piece and heel of the sole so as to form part of the surface thereof in contact with a bottom surface of the shell.

The tests carried out with the ski-boot according to the present invention have demonstrated, on the one hand, that the responsiveness and accuracy of transmission of the movements from the skier's leg and foot to the ski is maintained at an excellent level, compatible in particular with high-quality competition boots owing to the counter-sole made of rigid material, and, on the other hand, that there is a substantial reduction in the sensation of fatigue and pain affecting not only the lower limbs but also the back of the skier when the ski is used on hard and not perfectly smooth surfaces. As a result of the system of mounted elements, e.g. blocks, the vibrations of the sole are reduced substantially, enabling the skier to perform more precisely and efficiently the athletic movement of reversal of the edges of the skis.

BRIEF DESCRIPTION OF THE DRAWINGS

The present invention is illustrated, with regard to its two preferred embodiments, in the description which follows with reference to the accompanying drawings provided by way of a non-limiting examples. In the accompanying drawings.

DESCRIPTION OF THE PREFERRED EMBODIMENTS

FIGS. 1 to 4 illustrate in particular a portion of the rigid shell 20 of the boot, on the bottom 22 of which a conventional wedge 24 rests internally via an insert or counter-sole 25 which is made of aluminium or wood or compound plastic materials, and which is also light and at the same time is rigidly integral with the shell 20 which is injected onto it and which has the function of increasing the responsiveness and accuracy of reaction during transmission of the movements from the skier's limb to the ski via the boot.

Figure 4:
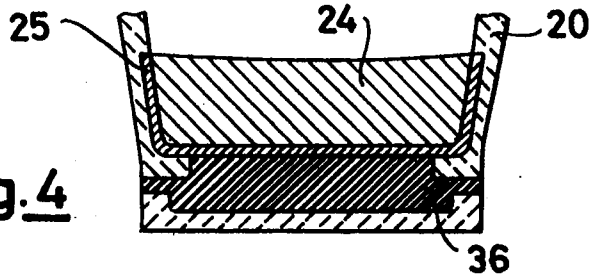
FIGS. 2, 3 and 4 are sectional views along the planes II—II, III—III and IV—IV, respectively, of FIG. 1.
Figure 3:
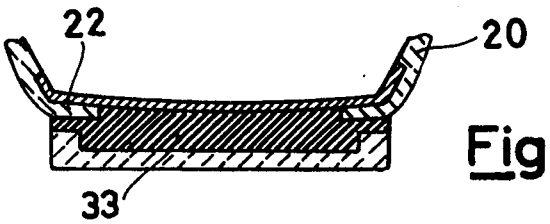
Figure 1:
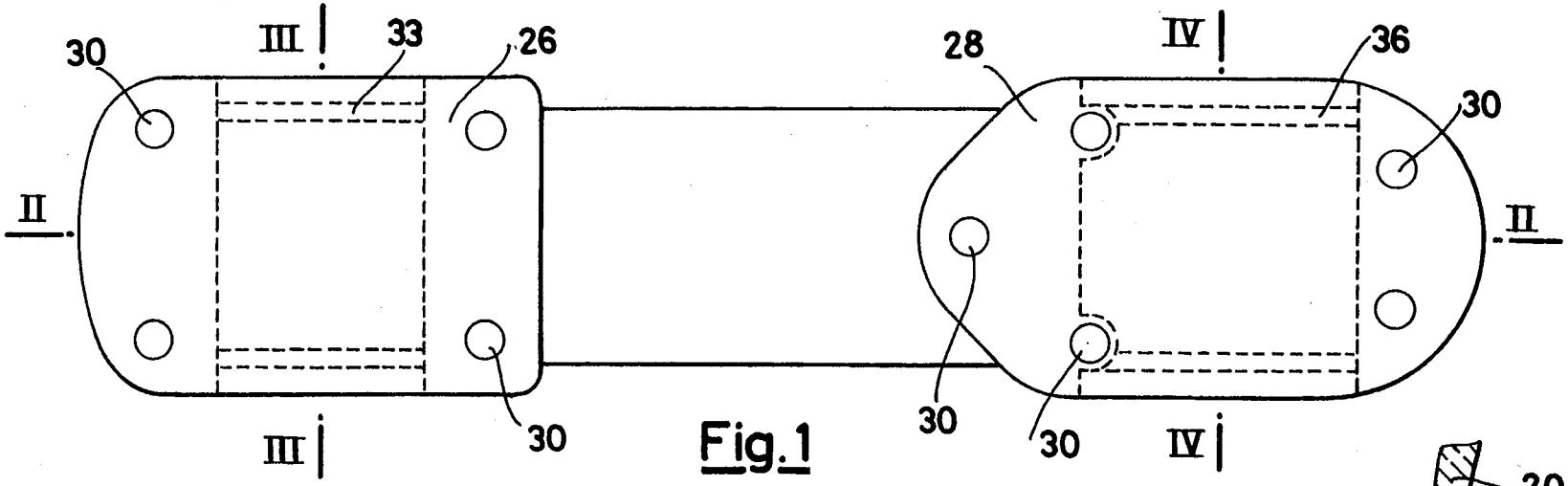
FIG. 1 is plan view of the bottom of the ski-boot according to a first embodiment of the present invention.
Figure 2:
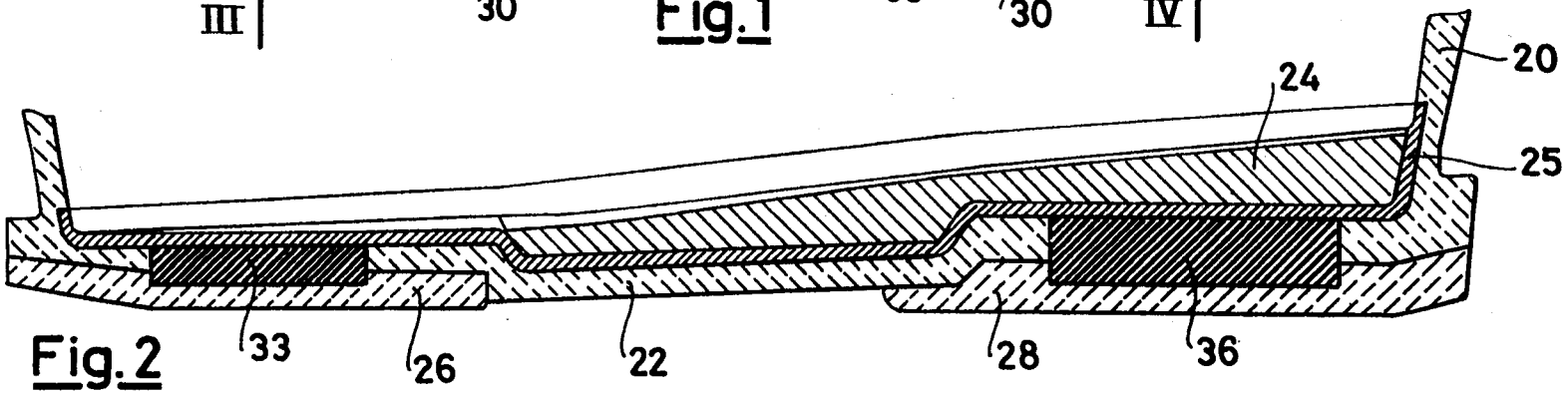
Figure 8:
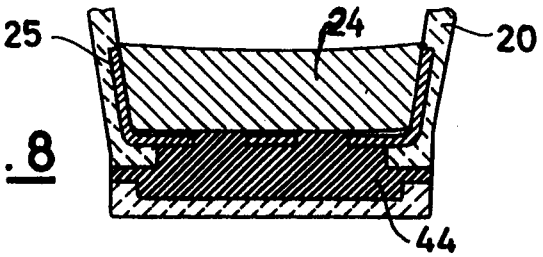
FIGS. 5, 6, 7 and 8 are views, corresponding to those of FIGS. 1–4, of a second embodiment of the invention.
Figure 7:
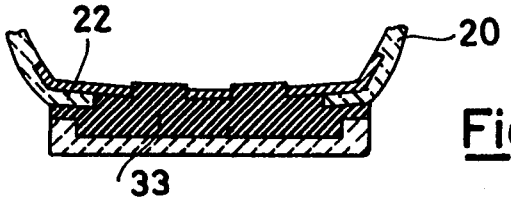
Figure 5:
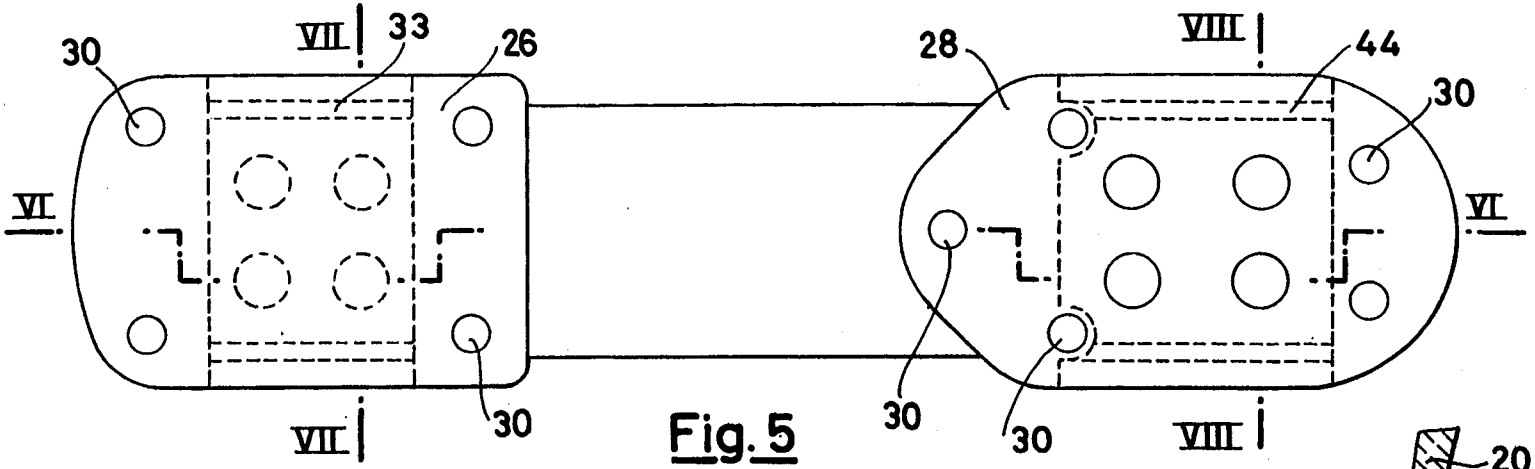
Figure 6:
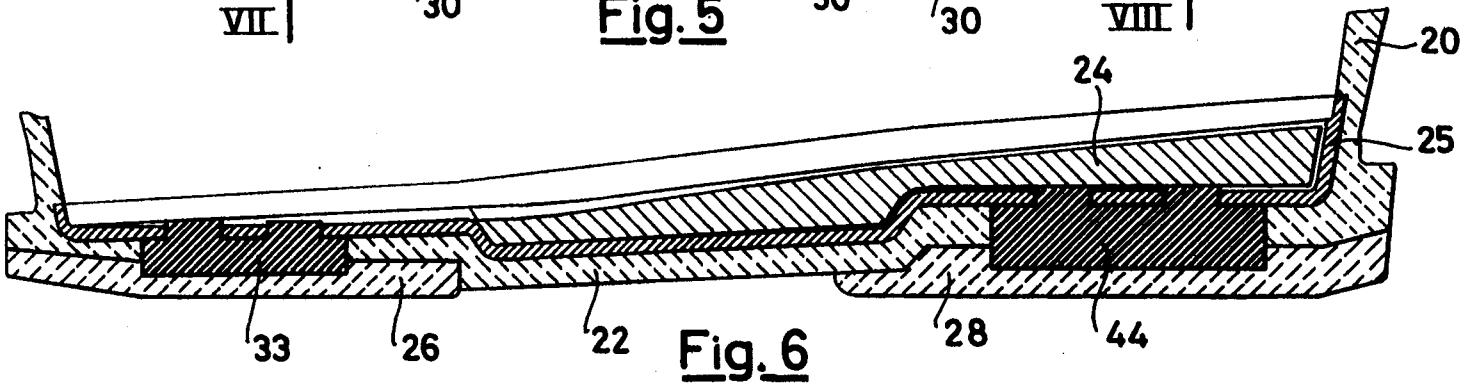

The sole of the boot consists in this case of two portions 26 and 28, the toe part and heel part respectively, which are fixed externally to the bottom of the shell 20 in the conventional manner, for example by means of screws, 30 of which in FIG. 1 represents the outlines thereof. As shown in broken lines in FIG. 1 and in the cross-sections of FIGS. 2 to 4, the two mounted elements 33 and 36 are made from a resilient material, such as polybutadiene rubber, unmodified polyurethane, and expanded or semi-rigid polymer, for example, and are anchored at the respective toe and heel parts 26 and 28.

In particular in this embodiment the mounted elements 33 and 36 extend through the bottom 22 of the shell 20 of the boot until they come into contact with the rigid insert or counter-sole 25.

Since the movements imparted by means of the skier's legs and feet to the ski are transmitted via the toe and heel parts of the boot it is obvious that these movements pass through the mounted elements or blocks 33 and 36. Without affecting the accuracy and responsiveness of the transmission of the movements in question, the result obtained is a substantial reduction in the sensation of fatigue (which may even take the form of actual pain) experienced when a boot with a high degree of accuracy and responsiveness in the transmission of movements (i.e. a boot of the type suitable and designed for competition) is used on a hard snowy and not perfectly flat surface.

When the mounted elements or blocks 33 and 36 have large dimensions, namely form a portion not smaller than the area of the toe and heel parts of the sole, it is envisaged, in order to obtain greater strength and wear as well as greater rigidity (responsible for the responsiveness and accuracy of transmission of the movements), to reinforce the blocks themselves, for example, by using a stiffening material therein, such as a thermoplastic or thermo-setting material mixed with the resilient material, e.g. the stiffening material being in the form of linear elements and fibers, e.g. carbon fibers, and kelvar, or by using polyester coinjected with polybutadiene rubber or reinforcing fibres or the like.

The embodiment of FIGS. 5 to 8 consists of a variation with respect to that shown in FIGS. 1 to 4, in which the block or resilient mounted element 44 passes not only through the bottom 22 of the shell 20, but also through, at least in part the rigid counter-sole 25 until it makes contact with the bottom of the wedge 24.

The invention has been described with regard to two of its preferred embodiments, but it remains understood that conceptually and mechanically equivalent modifications and variations are possible and may be envisaged without departing from the scope thereof.

We claim:

1. A ski boot for transmitting movements of a skier's foot to a ski attachable to the ski boot, comprising:

(a) a rigid shell having a sole with an internal surface and a bottom;

(b) a separate toe part and a separate heel part connected to the bottom of the sole;

(c) a rigid counter-sole superimposed on and within the sole;

(d) a first resilient mounted element having a lower end surface and an upper end surface and extending over at least most of a width of the sole and disposed such that at least a major portion of the lower end surface contacts the toe part and at least a major portion of the upper end surface contacts the counter-sole such that the toe part and the counter-sole are spaced from each other by said first resilient mounted element;

(e) a second resilient mounted element having a lower end surface and an upper end surface and extending over at least most of a width of the sole and disposed such that at least a major portion of the lower end surface contacts the heel part and at least a major portion of the upper end surface contacts the counter-sole such that the heel part and the counter-sole are spaced from each other by said second resilient mounted element;

(f) said first and second mounted elements passing through the sole; and (g) said counter-sole being rigidly attached to said sole and substantially abutting said upper end surfaces of said mounted elements and abutting the internal surface of said sole at all locations of the counter-sole except at locations at which said upper surfaces contact the counter-sole.

2. Ski-boot according to claim 1, wherein the mounted elements are made of a resilient material selected from polybutadiene, unmodified polyurethane and an expanded or semi-rigid polymer.

3. Ski-boot according to claim 2, wherein the resilient material contains a stiffening material selected from a thermoplastic or thermo-setting material mixed with said resilient material.

4. Ski-boot according to claim 3, wherein the stiffening material is in a form selected from the group consisting of linear elements, fibers, and carbon fibers.

5. Ski-boot according to claim 1, wherein said mounted elements are in the form of blocks, which are coinjected or anchored or interposed in said sole.

6. Ski-boot according to claim 1, wherein a wedge is disposed inside said boot and above said counter-sole and said mounted elements pass through, in part, said counter-sole and contact lower surfaces of said wedge.

7. Ski-boot according to claim 1, wherein the counter-sole covers internally a bottom of said shell.

8. Ski-boot according to claim 7, wherein said counter-sole is made of aluminum, wood or compound plastic materials.

* * * * *